US005213381A

United States Patent [19]

Anderson

[11] Patent Number: 5,213,381

[45] Date of Patent: May 25, 1993

[54] DRAW LATCH

[75] Inventor: John P. Anderson, Norco, Calif.

[73] Assignee: The Hartwell Corporation, Placentia, Calif.

[21] Appl. No.: 981,195

[22] Filed: Nov. 25, 1992

[51] Int. Cl.[5] ..... E05C 5/02

[52] U.S. Cl. ..... 292/111

[58] Field of Search ..... 292/111, 98, 113, 115, 292/140, 247

[56] References Cited

U.S. PATENT DOCUMENTS 2,605,123 7/1952 Claud-Mantle ..... 292/113

4,758,031 7/1988 Wolf ..... 292/111

FOREIGN PATENT DOCUMENTS 702842 1/1965 Canada ..... 292/111

*Primary Examiner*—Richard E. Moore

*Attorney, Agent, or Firm*—Harris, Kern, Wallen & Tinsley

[57] ABSTRACT

A draw latch for a container or the like including a latch mounting bracket, a U-shaped yoke, with the bracket and yoke interconnected for pivoting of the yoke relative to the bracket, a hook with a U-shaped end defining a cam space, with the bight of the yoke slidingly positioned in the cam space, and a cam carried in the cam space for translation and rotation relative to the hook and yoke for actuating the latch.

16 Claims, 5 Drawing Sheets

FIG 10
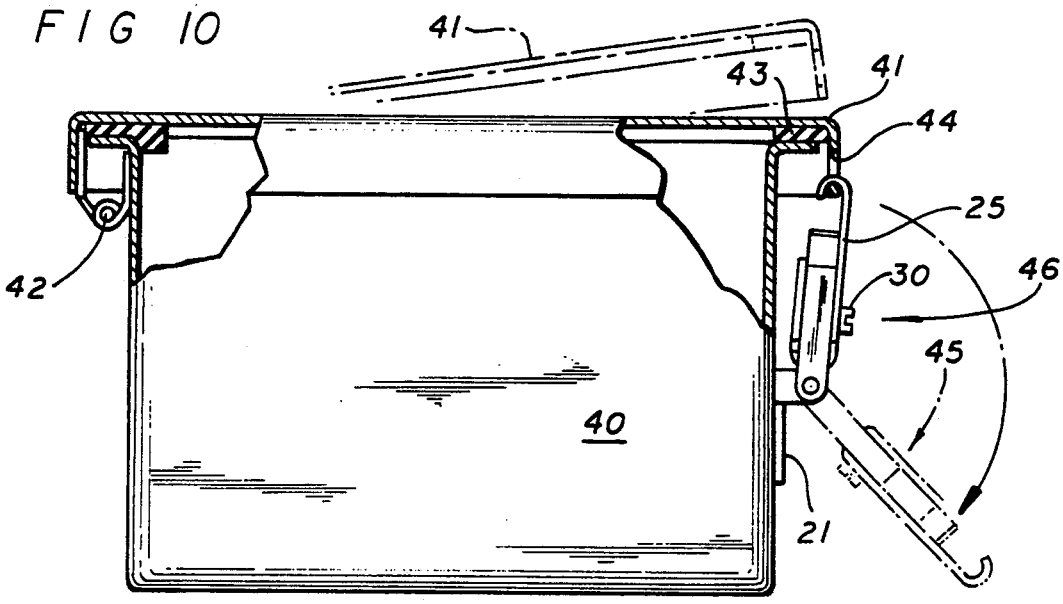
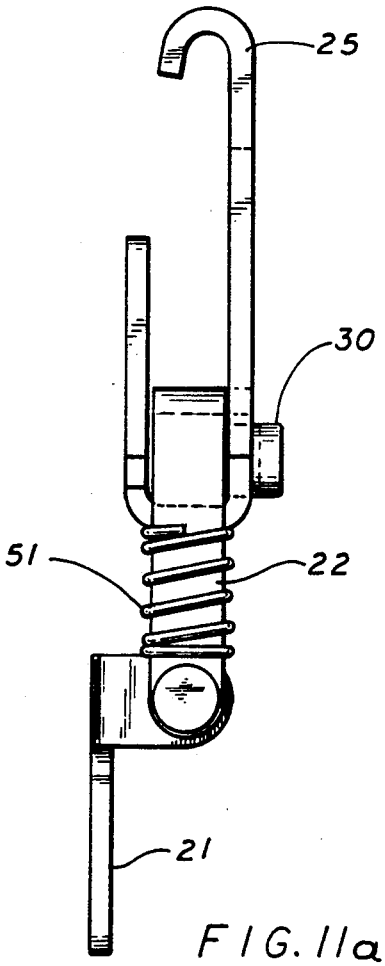
FIG. 11a
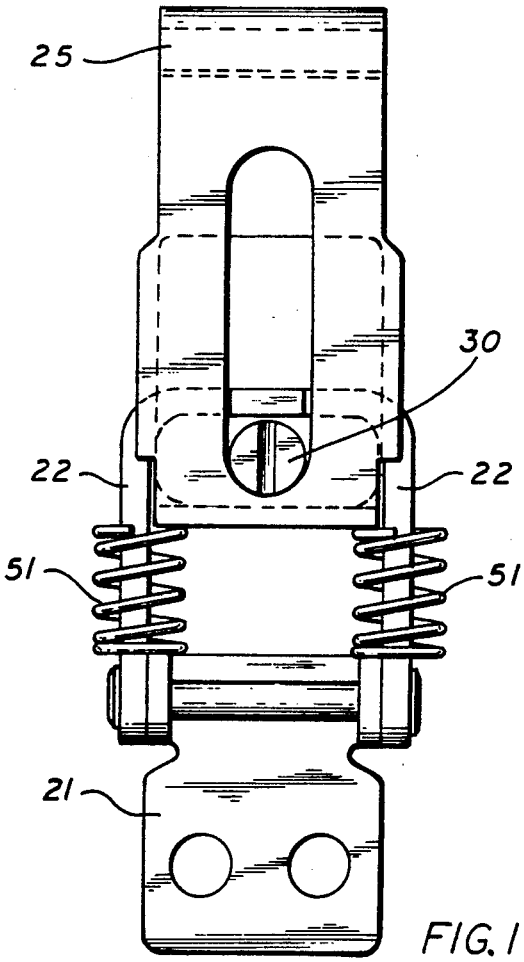
FIG. 11b

DRAW LATCH

BACKGROUND OF THE INVENTION

This invention relates to latches for containers and other forms of enclosures of the type sometimes referred to as draw latches. Two variations of draw latches are shown in U.S. Pats. No. 3,150,893 and 4,758,031.

A typical draw latch has either a cam that rotates about a fixed center point or a handle that pivots from a hinge pin on the mounting bracket. The movement of the cam or handle draws the hook of the latch toward the mounting bracket to a latched condition. Typically, there is some form of over-center condition that holds the hook in the latched position. The present invention is particularly directed to a draw latch of the cam operated type and, preferably, which can be operated by a tool.

SUMMARY OF THE INVENTION

It is an object of the invention to provide a new and improved draw latch which has relatively few parts which are easy to manufacture and assemble. A further object is to provide such a draw latch utilizing a free-floating cam rather than a cam which operates on a fixed axis, and a latch which is suitable for operation with a tool, although one which can also be operated with a fixed handle.

Tool actuated latches are sometimes required to prevent easy access. Typically, the tool could be a screwdriver, a wrench, an Allen wrench, or a special shaped tool.

The presently preferred embodiment of the draw latch of the invention includes a latch mounting bracket, a U-shaped yoke, a pin or other means for interconnecting the bracket and yoke for pivoting of the yoke relative to the bracket, a hook with a U-shaped end defining a cam space with the bight of the yoke slidingly positioned in the cam space, and a cam carried in the cam space for translation and rotation relative to the hook and yoke.

The cam may be configured to accept a tool for rotating the cam or may have a lever or handle or the like permanently carried on the cam.

The draw latch preferably incorporates a detent device which will tend to remain in the latched or closed condition, requiring an external force to be moved to the unlatched or open condition. In one embodiment, a spring is incorporated in the draw latch for this purpose. In an alternative embodiment, the container or other item being latched can have a compression gasket or other arrangement for maintaining the latch in the closed position.

Other objects, advantages, features and results will more fully appear in the course of the following description.

BRIEF DESCRIPTION OF THE DRAWINGS

FIG. 10 illustrates the use of the latch of FIGS. 7 and 8 on a container;

FIGS. 11*a* and 11*b* illustrate another embodiment utilizing a pair of springs;

DESCRIPTION OF THE PREFERRED EMBODIMENTS

Figure 1:
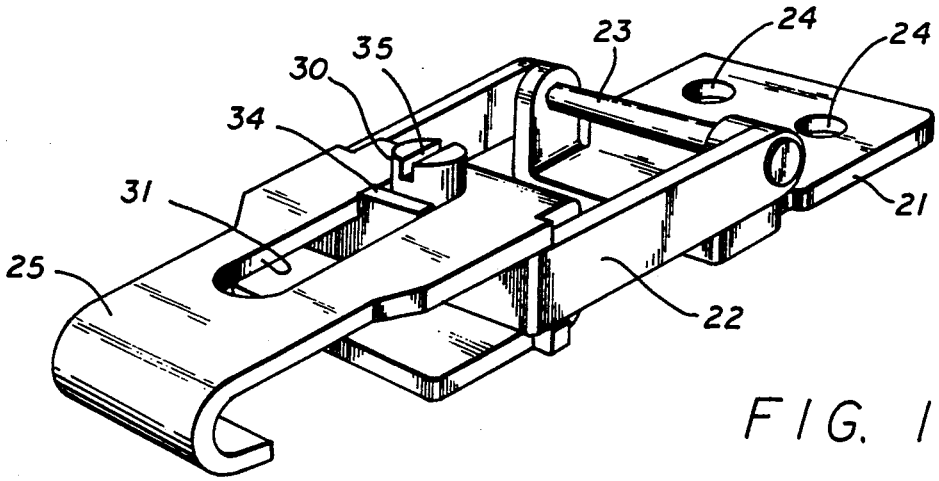
FIG. 1 is an isometric view of a draw latch incorporating the presently preferred embodiment of the invention.
Figure 2:
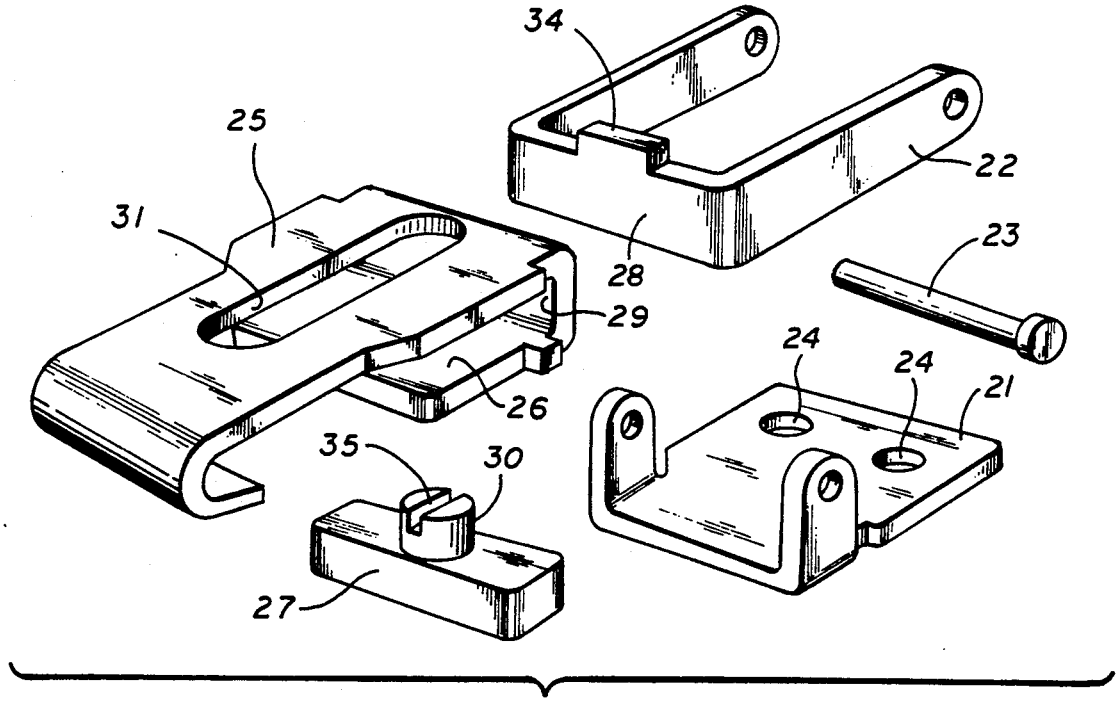
FIG. 2 is an exploded view of the components of the draw latch of FIG. 1.

The latch of FIGS. 1 and 2 includes a mounting bracket 21 and a U-shaped yoke 22, with the yoke pivotally mounted on the bracket by a pin 23. The pin has a head at one end and the other end may be expanded by peening or riveting after assembly. In use, the bracket 21 is mounted on the container or other object to be latched, by conventional means, such as connectors through openings 24 or welding or otherwise as desired. Also, the mounting bracket can be manufactured integral with the design.

The latch further includes a hook 25, typically with one end bent over to engage a keeper, and with the other end bent in a U-shape to define a cam space 26. A cam 27 is positioned in the cam space 26 between the bight 28 of the yoke 22 and the wall 29 of the hook 25.

The cam floats in the cam space between the yoke 28 and wall 29 and preferably has a boss 30 which rides in a slot 31 in the hook 25. The interengagement of the boss and slot serve to maintain the cam in position in the latch while permitting floating of the cam.

In the preferred embodiment, a tab 34 is provided on the yoke 28, with the tab also sliding in the slot 31 for maintaining the yoke and hook in alignment.

Figure 4:
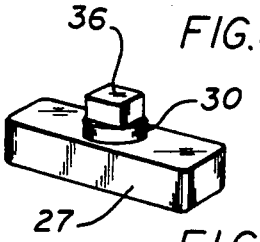
FIG. 4 is an isometric drawing of a cam for the draw latch, having an alternative arrangement for rotation of the cam.
Figure 6:
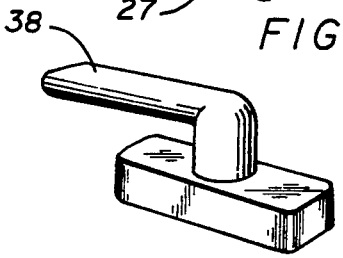
FIG. 6 is a view similar to that of FIG. 4 showing a cam with an attached handle.
Figure 5A:
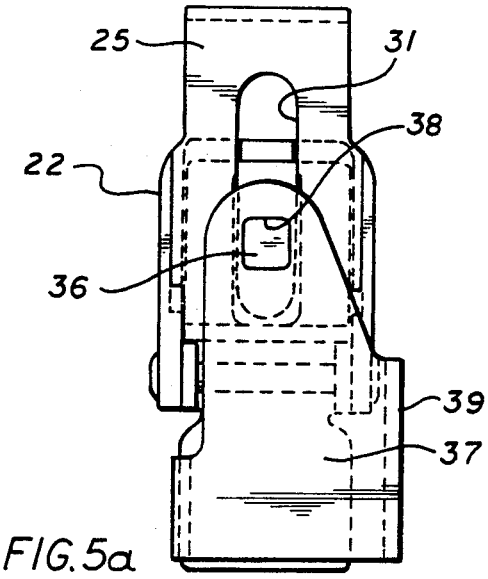
FIGS. 5*a* and 5*b* illustrate a form of handle for rotating the cam.
Figure 5B:
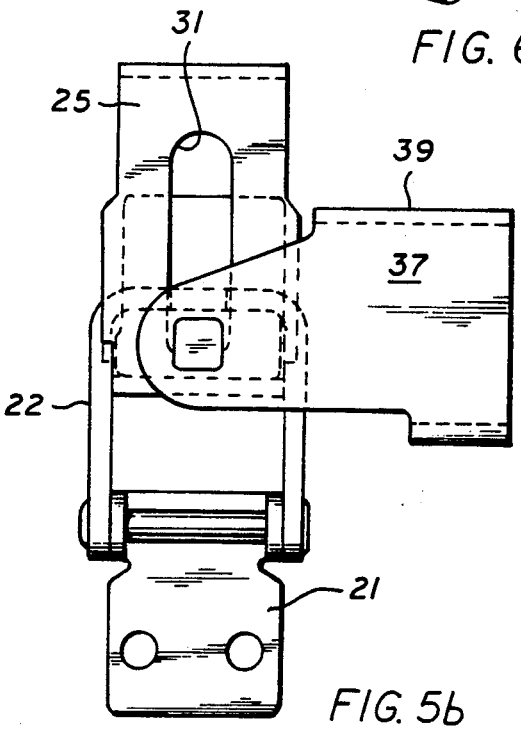

The cam may be operated by a tool, and the boss 30 illustrated in FIGS. 1 and 2 may have a slot 35 for engagement by a screwdriver. An alternative configuration is shown in FIG. 4 with a square head 36 on the boss 30, suitable for operation by a wrench or similar tool. Other shapes for the boss may be utilized for rotating the cam, such as an opening for an Allen wrench or an opening for a special designed tool. Another arrangement for rotating the cam is shown in FIGS. 5*a* and 5*b*. A handle 37 has an opening 38 for receiving the square section 36 of the cam. The handle may be fixed to the cam, as by pinning or other type of means, or may be removable by the operator. The latch is shown in the latched condition in FIG. 5*a* and in the unlatched condition in FIG. 5*b*. A cam with a fixed handle 38 is shown in FIG. 6.

Figure 3A:
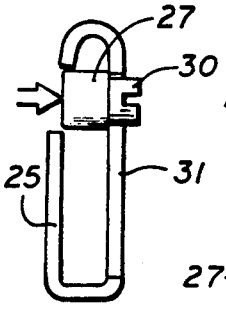
FIGS. 3*a*–3*g* diagrammatically illustrate the assembly and latching operation of the latch of FIGS. 1 and 2.
Figure 3B:
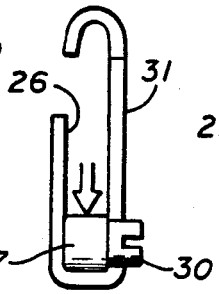
Figure 3C:
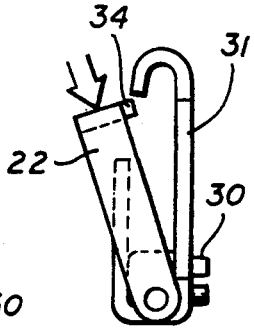
Figure 3D:
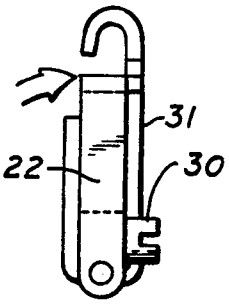
Figure 3E:
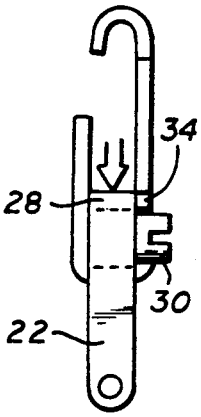
Figure 3F:
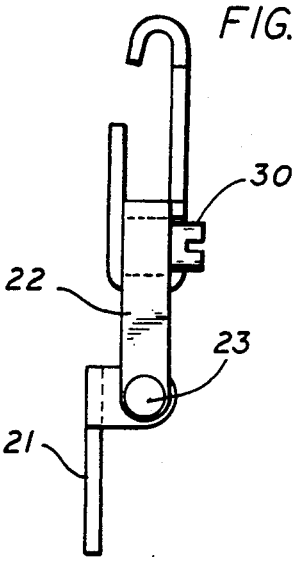
Figure 3G:
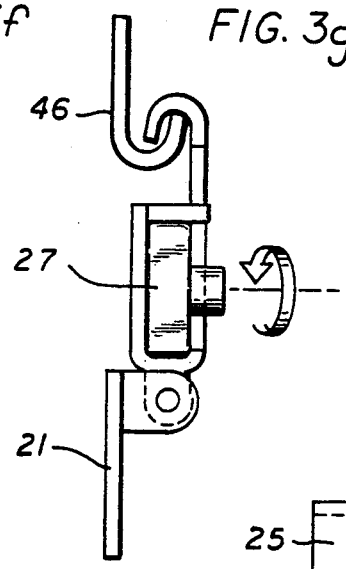

The assembly sequence of the latch is illustrated in FIGS. 3*a*–3*g*. The cam 27 is inserted into the hook 25, with the can boss 30 in the hook slot 31 (FIG. 3*a*). The cam then slides in the cam space 26 of the hook (FIG. 3*b*). Next the yoke 22 is inserted into the cam space, with the yoke tab 34 in the slot 31 (FIGS. 3*c* and 3*d*). The yoke slides in the cam space with the yoke bight 28 resting on the cam (FIG. 3*e*). The arms of the yoke are aligned with the arms of the mounting bracket 21 and the pin 23 is inserted through the aligned openings and pinned or otherwise fixed in place (FIG. 3*f*). The latch is now in the unlatched position. In use, the free end of the hook is engaged with a keeper 46 and the cam is rotated 90° to draw the hook to the latched position (FIG. 3*g*).

The draw latch of the invention is used in the same manner as conventional prior art draw latches. One such use is shown in FIG. 10 with a container 40, a lid 41 attached to the container by a hinge 42, and with a compression gasket 43 around the rim of the container. The bracket 21 is attached to the side of the container, as by welding or riveting, and the hook 25 is positioned in a slot 44 in the cover 41.

The latch is shown at 45 in the unlatched position. To latch the cover on the container, the latch is rotated upward to the position 46 with the hook in the slot. Then the cam 27 is rotated to move the hook toward the yoke, compressing the gasket 43.

The preferred shape for the cam is rectangular. With this arrangement, the cam has two lobes and when rotated, one lobe pushes against the wall 29 of the hook, and the other lobe pushes against the bight 28 of the yoke. Each end of the cam has a flat portion with rounded corners. The rounded corners are the highest point of the cam so that the flat portions at each end act as detents so that the cam is maintained in the rotated position when the latch is fully latched. The flat portions at the ends of the cams seat against the hook and the yoke.

This mode of operation can be utilized with the compression gasket or other arrangement for maintaining the latch in the latched position. Alternatively, various forms of springs in a manner to be described, can be incorporated in the latch for achieving this function.

The operation of the latch with a handle is further illustrated in FIGS. 5*a* and 5*b*. With the cam in the position of FIG. 5*b*, the hook may extend away from the pivot pin of the yoke, so that the turned over end of the hook can engage a keeper. Then the cam is rotated 90° from the position of FIG. 5*b* to the position of FIG. 5*a*. This action draws the hook toward the pivot pin 23, shortening the distance between the pin and the free end of the hook to obtain the latched position.

The handle 37 may include a leg 39 which acts as a stop against the side of the latch to limit the handle rotation to 90°. In another variation, the handle could be hinged to fold down flat. Alternatively, the handle could be removably mounted with a screw or other fastener on the boss of the cam.

When desired, a spring configuration can be incorporated in the draw latch to provide the force desirable for maintaining the structure in the latched condition. One such arrangement is shown in FIGS. 7, 8 and 9. A spring retainer 48 is positioned in the slot 31 of the hook 25, as shown in FIGS. 7 and 8. The spring retainer has a body portion 49 with wings 50 and an end 51 for fitting in the slot, and opposed tabs 52 for retaining the retainer in the slot. A coil spring 53 is positioned in the slot between the end 51 of the retainer 49 and the outer side of the bight 28 of the yoke 22.

Figure 7A:
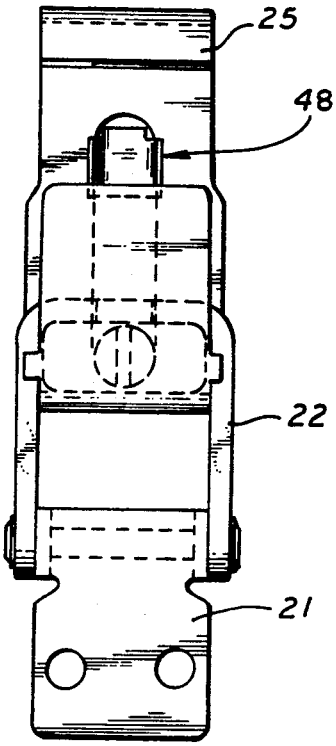
FIGS. 7*a*–7*c* show an alternative embodiment of the latch of FIG. 1 with an internal spring, with the latch in the unlatched condition.
Figure 7B:
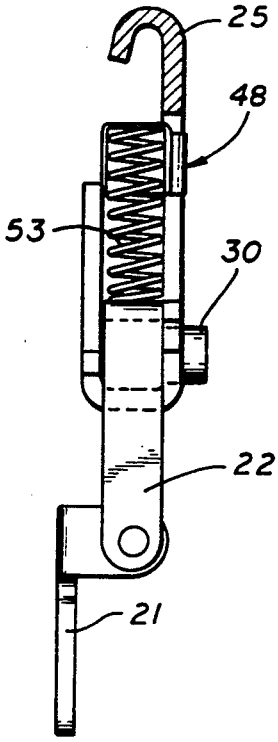
Figure 7C:
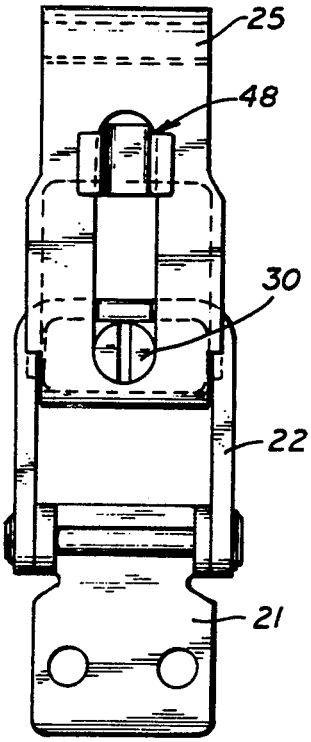
Figure 8A:
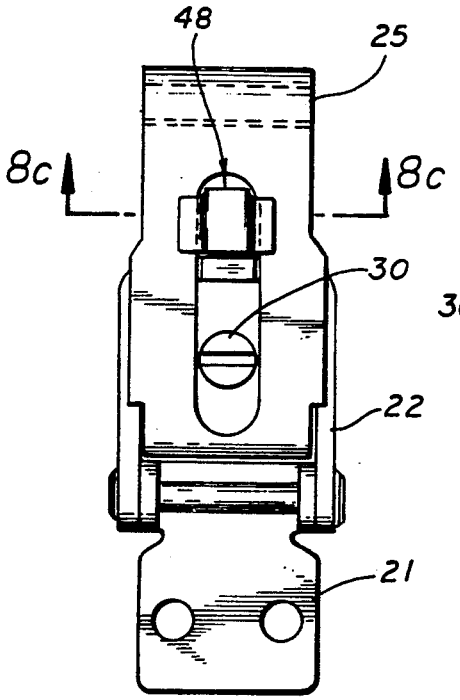
FIGS. 8*a* and 8*b* show the latch of FIGS. 7*a*–7*c* in the latched position.
Figure 8B:
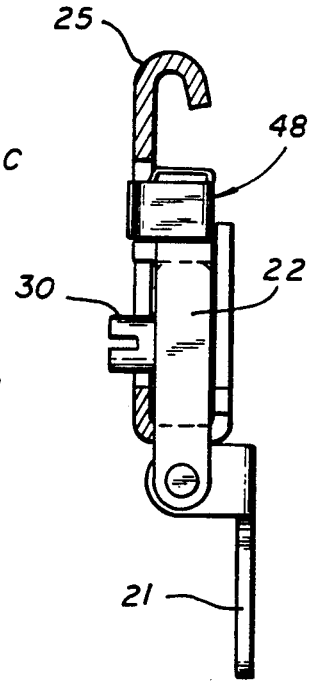
Figure 8C:
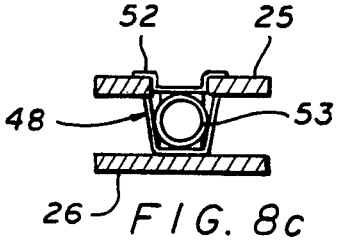
Figure 9:
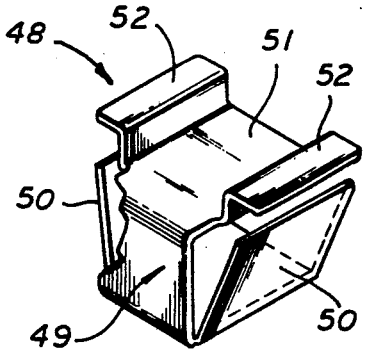
FIG. 9 illustrates the spring holder of FIGS. 7*a*–7*c*, 8*a* and 8*b*.

This installation is shown with the latch in the unlatched position in FIGS. 7*a*, 7*b* and 7*c* and in the latched position in FIGS. 8*a*, 8*b* and 8*c*. FIG. 7*a* is a bottom view of the latch, FIG. 7*b* is a side view partly in section, and FIG. 7*c* is a top view. FIG. 8*a* is a top view, FIG. 8*b* is a side view partly in section, and FIG. 8*c* is a sectional view taken along the line 8*c*–8*c* of FIG. 8*a*.

Another spring construction is shown in FIGS. 11*a* and 11*b*, with a coil spring 51 on each leg of the yoke 22. The operation of the draw latch is the same as for the previously described embodiment.

Another spring configuration is shown in FIGS. 12 and 13*a*–13*c*, with a clip 53 having a base 54, opposed projecting catches 55, and opposed projecting fingers 56.

The clip is positioned in the slot 31 of the hook 25 with the base 54 resting on the hook. The catches 55 pass through the slot and extend outwardly over the hook on the side opposite the base 54, holding the clip in place. The fingers 56 lie in the cam space 26 and rest against the cam 27.

Figure 13A:
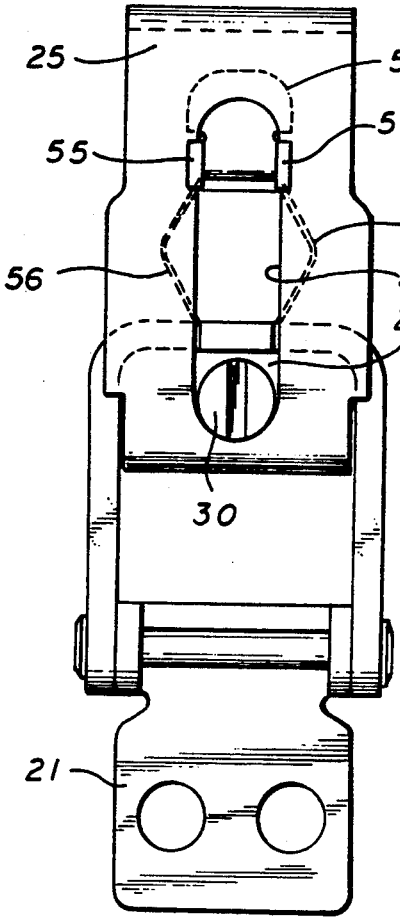
FIGS. 13*a*–13*c* illustrate another embodiment of the latch incorporating the clip of FIG. 12.
Figure 13B:
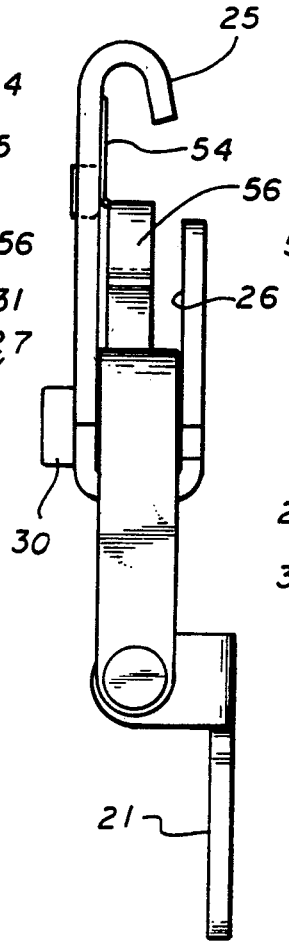
Figure 13C:
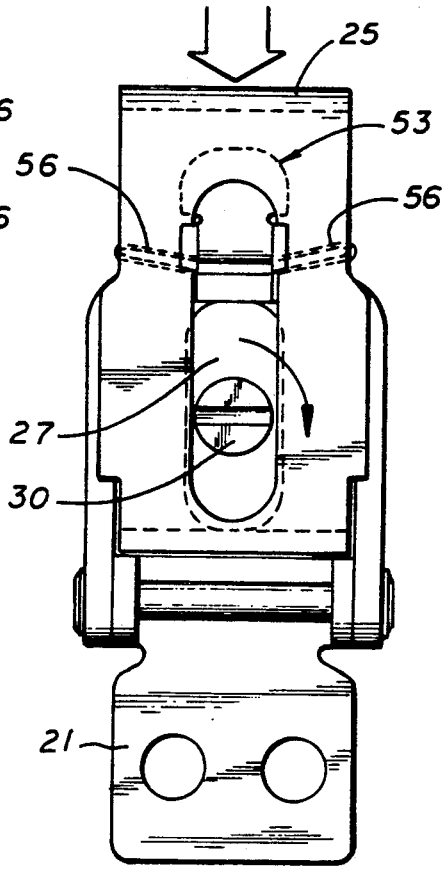
Figure 12:
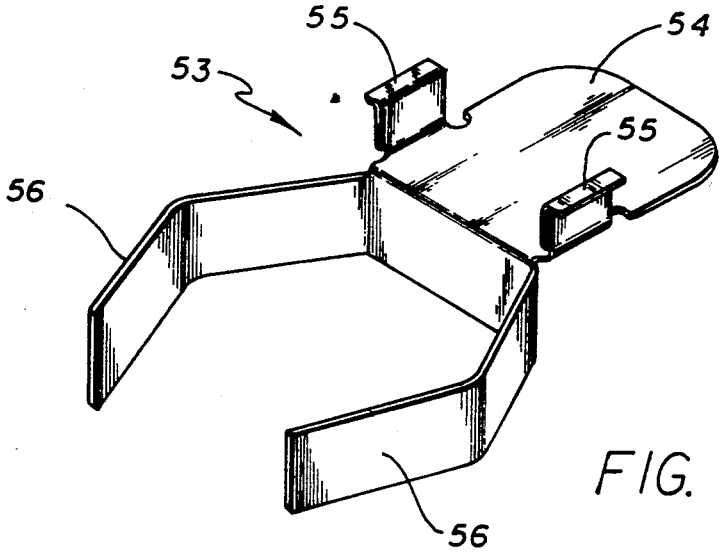
FIGS. 12 is an isometric view of a spring clip.

The latch with clip 53 is shown in the unlatched position in FIGS. 13*a* and 13*b*. When the cam is rotated to the latched position of FIG. 13*c*, the fingers 56 are compressed and exert a force between the yoke and hook urging the hook away from the yoke and thereby maintaining the latch in the detent position restricting rotation of the cam.

In operation, when the latch is under a load, the cam is held tight between the hook and the yoke. The flats on the ends of each lobe of the cam act like detents and hold the cam in the latched position. When the cam is intentionally rotated, the holding force produced by the spring or gasket or other item is overcome.

The draw latch of the present invention incorporates a cam which is free to float along the axis of the latch, rather than requiring a shaft for rotation about a fixed point. In place of the conventional over-center arrangement for the hook, the latch uses the flat end configuration of the cam for the detent action to hold the cam in the latched position. The draw latch of the invention is a simple design requiring only four parts including the mounting bracket, and a pin or rivet for the assembly. Such design is easy to manufacture and to assemble, requiring a minimun of operations for the assembly, while at the same time providing latching performance equal to or superior to that of prior latches.

I claim:

1. In a draw latch, the combination of:

a latch mounting bracket;

a U-shaped yoke;

means for interconnecting said bracket and yoke for pivoting of said yoke relative to said bracket;

a hook with a U-shaped end defining a cam space, with the bight of said yoke slidingly positioned in said cam space; and a cam carried in said cam spare for translation and rotation relative to said hook and yoke.

2. A draw latch as defined in claim 1 including a tab on said bight of said yoke, and a tab receiving slot in said hook guiding sliding of said hook relative to said yoke.

3. A draw latch as defined in claim 1 wherein said cam is rectangular in plan and includes means for rotating said cam in said cam space to move said hook relative to said yoke, drawing said yoke toward said bracket.

4. A draw latch as defined in claim 3 wherein said cam includes a projecting boss and said hook includes means defining a slot for slidingly receiving said cam boss.

5. A draw latch as defined in claim 4 including a tab on said bight of said yoke for positioning in said slot of said hook for guiding sliding of said hook relative to said yoke.

6. A draw latch as defined in claim 4 wherein said boss of said cam includes a tool receiving opening.

7. A draw latch as defined in claim 4 wherein said boss of said cam includes a tool engaging section.

8. A draw latch as defined in claim 4 including a handle carried on said boss of said cam for rotating said cam.

9. A draw latch as defined in claim 4 including spring means positioned between said yoke and hook for urging said hook away from said yoke.

10. A draw latch as defined in claim 9 wherein said spring means includes a spring retainer carried in said slot of said hook, and a spring positioned between said bight of said yoke and said spring retainer.

11. A draw latch as defined in claim 9 wherein said spring means includes a coil spring around each leg of said U-shaped yoke.

12. A draw latch as defined in claim 9 wherein said spring means comprises a spring clip having a base with opposed projecting catches for positioning in said slot of said hook and opposed projecting fingers for positioning in said cam space.

13. A draw latch as defined in claim 1 including spring means positioned between said yoke and hook for urging said hook away from said yoke.

14. A draw latch as defined in claim 13 wherein said spring means includes a spring retainer carried on said hook, and a spring positioned between said bight of said yoke and said spring retainer.

15. A draw latch as defined in claim 13 wherein said spring means includes a coil spring around each leg of said U-shaped yoke.

16. A draw latch as defined in claim 13 wherein said spring means comprises a spring clip carried on said hook and having a base with opposed projecting fingers for positioning in said cam space.

* * * * *